United States Patent [19]

Allen

[11] 4,024,915

[45] May 24, 1977

[54] RECOVERY OF VISCOUS OIL BY UNHEATED AIR INJECTION, FOLLOWED BY IN SITU COMBUSTION

[75] Inventor: Joseph C. Allen, Bellaire, Tex.

[73] Assignee: Texaco Inc., New York, N.Y.

[22] Filed: Jan. 15, 1976

[21] Appl. No.: 649,294

Related U.S. Application Data

[63] Continuation of Ser. No. 493,286, July 31, 1974, abandoned.

[52] U.S. Cl. ..... 166/256; 166/305 R

[51] Int. Cl.[2] ..... E21B 43/24

[58] Field of Search ..... 166/256, 260, 261, 272

[56] References Cited

UNITED STATES PATENTS

| | | | |
|---|---|---|---|
| 2,839,141 | 6/1958 | Walter | 166/261 |
| 3,019,837 | 2/1962 | Marx et al. | 166/256 |
| 3,034,579 | 5/1962 | Parker | 166/256 |
| 3,205,944 | 9/1965 | Walton | 166/261 |
| 3,209,825 | 10/1965 | Alexander et al. | 166/256 |
| 3,221,809 | 12/1965 | Walton | 166/272 |
| 3,232,345 | 2/1966 | Trantham et al. | 166/256 |
| 3,334,687 | 8/1967 | Parker | 166/256 |
| 3,375,871 | 2/1968 | Parker | 166/261 |
| 3,386,507 | 6/1968 | Lumplin | 166/256 |
| 3,499,490 | 3/1970 | Needham et al. | 166/272 |

*Primary Examiner*—Ernest R. Purser
*Attorney, Agent, or Firm*—Thomas H. Whaley; Carl G. Ries; Jack H. Park

[57] ABSTRACT

Disclosed is a method for recovering low gravity, viscous petroleum including bitumen from a tar sand deposit by injecting unheated air followed by a soak period so that the viscous petroleum is conditioned by contact with the unheated air, followed by injection air or a mixture of heated air and steam to accomplish in situ combustion or low temperature oxidation within the viscous petroleum formation. The temperature of the unheated air injected in the first phase is less than 250° F and preferably less than 150° F, so as to avoid a combustion reaction between the air and the petroleum in the formation. The preliminary treatment with unheated air results in eliminating or decreasing the tendency for spontaneous ignition to occur at random sites in the formation, and produces more uniform combustion and propagation of the combustion front through the formation, and results in increased oil recovery from the formation.

10 Claims, No Drawings

RECOVERY OF VISCOUS OIL BY UNHEATED AIR INJECTION, FOLLOWED BY IN SITU COMBUSTION

This is a continuation, of application Ser. No. 493,286, filed July 31, 1974 and now abandoned.

BACKGROUND OF THE INVENTION

1. Field of the Invention

The present invention relates to an improved method recovering viscous petroleum from subterranean, viscous petroleum-containing formations including tar sand or bitumen sand deposits. More particularly, the invention relates to the recovery of viscous from subterranean formations containing same by a preliminary treatment with unheated air followed by air in situ combustion or low temperature, controlled oxidation oil recovery.

2. Description of the Prior Art

There are many subterranean, petroleum-containing formations in various parts of the world from which substantial amounts of petroleum cannot be recovered because the viscosity of the petroleum is so great that it is essentially immobile at reservoir conditions. Thus even if the formation contains adequate permeability, and an extraneous fluid such as water is introduced into the formation to drive the petroleum to a production well, little or no petroleum can be recovered from the formation because the viscosity of the petroleum is so great that it will not move. It is generally recognized that if the API gravity of the petroleum contained in the subterranean formation is less than about 12°, little or no recovery of the petroleum may be accomplished by conventional primary or secondary recovery means.

It is well known in the art that some improvement in recovery efficiency can be achieved if the temperature of petroleum can be increased. The viscosity temperature relationship of most crude petroleum materials is relatively sharp, and so even though the viscosity may be in the thousands or even millions of centipoise at formation temperatures, by raising the temperature of crude petroleum to several hundred degrees Farenheit, the viscosity may be reduced to a sufficiently low value that it will flow or may be displaced by an extremely dry fluid to a production well where it can be pumped to the surface of the earth.

One of the most extreme examples of viscous petroleum containing formations from which essentially no production may be had by conventional primary or secondary means are the so called tar sand or bitumen sand deposits such as those located in the western United States, and the Athabasca Tar Sands in the northern portion of the province of Alberta, Canada, as well as in Venezuela. The viscosity of the bituminous petroleum contained in the Athabasca tar sand deposits, for example, is in the range of several million centipoise at the average formation temperature of about 40° F, and so the bituminous petroleum is essentially immobile at these temperatures. Additionally, the permeability of the Athabasca tar sand deposit is so low that the injection of a heating fluid thereinto is quite difficult, and so recovery of the bituminous petroleum from these deposits by any means other than mining has been essentially unsuccessful on any commercial level up to the present time.

One means which has been described in the prior art for increasing the mobility of high viscosity, low API gravity crudes is by means of in situ combustion, also referred to on the literature as fire flooding. In situ combustion is accomplished by introducing heated air into the formation, generally the temperature of the air being above about 350° F, as a result of which a combustion reaction is initiated within the formation. Continued injection of air into the formation after the initiation of this combustion reaction result in the propagation of this combustion front through the formation, heating and displacing crude petroleum ahead of it.

In application of a typical forward in situ combustion operation as applied to a subterranean formation which is penetrated by at least two wells, one for the purpose of injecting air or some other oxygen containing gas, and at least one for the purpose of recovering petroleum from the formation, an oxygen containing gas, generally air, is introduced into the formation via the injection well, and the combustion reaction is initiated in the petroleum saturated formation immediately adjacent to the injection well bore by means of any one of several known means, such as by the use of a gas fired downhole heater or a downhole electric heater or by chemical means. All of these injection techniques are well described in the literature. Once the ignition of a portion of the formation has been accomplished, additional heating is frequently not necessary, and the combustion reaction will be sustained by continued injection of the oxygen containing gas to propagate the combustion front through the formation.

As the combustion front advances through the formation, a swept area consisting ideally of clean sand is left behind the front. In advance of the combustion front and moving generally radially outward away from the injection well and predominantly in the direction of the production well, various sequential zones are formed. A distillation and cracking zone is formed immediately ahead of the combustion front, and in front of this zone is a condensation and vaporization zone, and finally an oil bank of heated petroleum is formed. The temperature of the combustion zone is generally in the range of from about 650° to about 1200° F. The heat generated in the zone is transferred to the distillation and cracking zone ahead of the combustion where the crude petroleum undergoes distillation and cracking. The temperature in the distillation and cracking zone is in the range of from about 300° to about 450° F.

Ahead of the distillation and cracking zone is a condensation and vaporization zone, which has a temperature of from about 200° to about 450° F, depending on the distillation characteristics of the petroleum contained therein and the pressure existing within that particular zone. Fluids present in this zone include water and steam as well as hydrocarbon components of the crude.

Ahead of the condensation and vaporization zone is an oil bank which forms as the in situ combustion front progresses through the formation and the formation crude is displaced toward the production well. This zone contains not only heated reservoir crude petroleum, but also condensate, cracked petroleum components, and some gaseous products of combustion which will ultimately pass through the production well along with crude petroleum.

Significant recovery stimulation has been experienced by application of conventional in situ combustion processes to moderately viscous petroleum. These techniques have not been altogether successful when applied to varied viscous petroleum, however, particularly bituminous petroleum such as is contained in the tar sand deposit. The build up of the oil bank ahead of the thermal front is believed to be a source of failure of fire flooding in tar sand deposits, since the unaltered petroleum present in the oil bank will become essentially immobile if it looses appreciable amounts of heat, which will occur as the bank moves into cooler portions of the formation.

Another source of failure of commercial exploitation of viscous petroleum formations by means of conventional in situ combustion is associated with the occurrence of zones or pockets of in situ combustion within the formation for several reasons. The zone of combustion initiated by the pockets of in situ combustion by spontaneous combustion may move in a direction opposite of that in a normal forward in situ combustion process, i.e., the zone may move toward the injection well, and thus consume the oil which has been mobilized by any other combustion fronts which have been established and caused to move in a direction from the injection well toward the production well. Similarly, the zone may remain essentially stationary, and thus consume a substantial portion of mobilized petroleum which moved into it as the desired combustion front progresses toward the production well.

For the above described reasons as well as other reasons which may not be entirely understood at the present time, the recovery of very viscous petroleum from subterranean formations such as tar sand deposits by means of in situ combustion has not been especially satisfactory, from the standpoint that the percentage of the oil removed has been quite low. Accordingly there is substantial need for a means of conducting an in situ combustion reaction so that no random pockets of spontaneous ignition occurs within the formation, and so as to achieve a significant increase in oil recovery from the formation.

SUMMARY OF THE INVENTION

This invention relates to an improved method for recovering viscous, low API gravity petroleum from subterranean formations, including the recovery of bituminous petroleum from subterranean tar sand deposits, by the injection of an oxygen containing gas including air into the formation, the gas being unheated, the temperature of the gas being below 250° and preferably below 150° F, after which unheated air injection is terminated and the unheated air is allowed to remain in the formation so as to contact and pretreat the viscous petroleum contained therein for a period of time from about 20 to about 200 days and preferably from about 50 to about 100 days. After this soak period of pretreatment phase is completed, an oxygen containing gas which is heated to a temperature of at least 600° F is introduced into the formation for the purpose of initiating an oxidative reaction such as in situ combustion, and thereafter air, which may be heated or unheated, is introduced into the formation to sustain the oxidative reaction and cause it to propagate through the formation toward the production well.

DESCRIPTION OF THE PREFERRED EMBODIMENT

Briefly, this invention relates to the production of viscous of low API gravity petroleum including bituminous petroleum from tar sand deposits, by a combination of a pretreatment with an unheated oxygen containing gas such as air for a period of time sufficient to alter the characteristics of the petroleum so as to render it more amenable to efficient recovery from the formation by in situ combustion or by a modified low temperature oxidation form of in situ combustion accomplished by injecting air and steam.

The first phase of the process of may invention, involving the pretreatment phase, requires that an oxygen containing gas be introduced into the formation and allowed to remain in contact with the viscous petroleum contained therein for a suitable period of time in order to precondition it prior to the introduction to heated oxygen containing gas for the final phase of the recovery operation, which will involve a conventional, forward in situ combustion reaction. Ordinarily air is the preferred pretreating gas, because it is readily available and usually it is the least expensive oxygen containing gas which can be introduced into the formation.

The pretreatment of the formation with other oxygen containing gases, including oxygen enriched air or essentially pure oxygen, may also be used to pretreat the viscous petroleum according to the process of my invention.

Ordinarily, air may be injected into the formation for suitable period of time so that essentially all of the pore space within the formation is saturated or filled with air or the oxygen containing gas being used, after which both the injection well and production well will be shut in at or above the natural formation pressure for a period of time sufficient to accomplish the relatively slow pretreatment of the viscous petroluem.

Ordinarily, the pretreatment reaction between the viscous petroleum contained in the formation and the air or other oxygen containing gas introduced there into at a temperature below 250° F, will be influenced favorably by increased pressure; that is to say, the reaction rate will ordinarily be a function of pressure. It is ordinarily desirable to introduce the air or other oxygen containing gas at a pressure in excess of the natural formation pressure, and maintain this pressure during the soak period. There are several limitations to this general rule, however, which should be observed in certain formations. In relatively shallow formations, or formations known to be overlaying by predominantly incompetent formations, care must be taken to avoid fracturing the overburden formation by introduction of gas under excessive pressure which will cause a fracture to occur, after which it will be essentially impossible to maintain gas within the formation because of the fracture through the overburden to the surface of the earth. As a general rule of thumb, this fracturing of the overburden formation will be avoided if the injection pressure in pounds per square inch is not greater than the depth of the thickness of the overburden expressed in feet. Thus, if the overburden formation is around 500 feet thick, the gas injection pressure should not exceed 500 pounds per square inch.

It must also be remembered that the compression of gas causes an increase in the temperature of the gas, and the temperature of the gas after compression and prior to injection into the well should be monitored to insure that its temperature is below the 250° F limitation, which prevents the spontaneous ignition of the formation to produce an immediate combustion reaction within the formation. If it is desired and possible to inject air into the formation at relatively high pressures, it may be necessary to utilize an after-cooler to reduce the temperature of the air after the compression phase, so that it is in the desired range which will not cause spontaneous ignition on contacting the formation petroleum. Thus a preferred embodiment comprises compressing gas and thereafter cooling it so that the high pressure, cool air or other oxygen containing gas may be injected into the formation.

The principal objective of the pretreatment phase of the process of my invention is to accomplish a prolonged contact between the unheated air and the viscous petroleum, to allow the conditioning reaction to occur. It is possible to accomplish this pretreatment reaction by at least two means. The air may be injected into the formation and then both the injection and production well shut in so that the air remains in an essentially static state in the formation at the desired pressure for the preselected reaction time, or the unheated air may be continually injected into the injection well and allowed to escape by the production well, so that unheated air is passed through the petroleum formation for the desired period of time.

The period of time during which it is desired that the unheated air be in intimate contact with the viscous formation petroleum will vary to some extent from one formation to another, and is a function of the temperature and pressure at which it is present in the formation. Generally, the desired pretreatment will be accomplished if the unheated oxygen containing gas or air is present in the petroleum saturated formation for a period of from about 20 to about 200 days, and preferably from about 50 to about 100 days. This dwell time is the same whether air is present in the formation with both wells shut in for a static pretreatment, or whether air is being passed through the formation to pretreat the petroleum in a dynamic fashion.

The temperature at which the air is introduced into the formation will ordinarily influence the minimum time which it must be present in the formation in order to accomplish the desired conditioning of the viscous petroleum. As previously stated, the rate of the preconditioning reaction will ordinarily be greater at a higher temperture, although it is necessary to avoid an ignition of the petroleum, and so there is an upper limit to the temperature of the oxygen containing gas. It is generally preferable to tolerate a slightly longer soak period of time and utilize an oxygen containing gas whose temperature is sufficiently low to insure that there will be essentially no likelihood of a combustion reaction occurring spontaneously in the formation. Ordinarily the combustion will be avoided if the oxygen containing gas temperature is below 250° F, and will certainly never occur if the temperature is below 150° F.

I have found that the unheated, low temperature oxidative reaction pretreatment of viscous petroleum will improve the recovery of viscous petroleum from formations by subsequent application thereto a conventional in situ combustion program involving the injection of heated, oxygen containing gas, or air, or to a recovery operation employing the injection of a mixture of an oxygen containing gas or air and steam or hot water which results in a low temperature or controlled temperature oxidative reaction which is somewhat more effective in application to very high petroleum viscosity containing formations such as tar sand deposits.

FIELD EXAMPLE NUMBER 1

A subterranean formation which contains 11° API petroleum is located at a depth of 1500 feet. The permeability of the formation is quite high and the formation is naturally confined by lateral formations such that alterations of the formation pressure may be accomplished easily.

Air is compressed to a pressure of 1,000 pounds per square inch, and cooled by a surface air heat exchanger to a temperature of 100° F and injected at this temperature into an injection well completed in the formation. A production well located 150 feet away from the injection well is shut in, and air injection is continued until the air flow rate drops essentially to 0 at 1,000 pounds per square inch injection pressure. The injection well is shut in and the pressure therein monitored, with additional air injection being done only if necessary to maintain the formation at a pressure of 1,000 pounds per square inch. The unheated air is maintained in the formation for four weeks, in order to insure proper conditioning of the viscous petroleum contained therein. Pressure is thereafter gradually released on both wells, and air injection without the precooling step is initiated into the injection well. A downhole gas fired burner is positioned adjacent perforations in the injection well tubing, to heat the injected air to a temperature of 650° F, which results in rapid ignition of the viscous petroleum in the formation adjacent the perforations in the injection tubing. The gas fired heater remains in the well bore 24 hours, after which it is removed and air is injected at a pressure of 800 pounds per square inch and at a flow rate of 1 million standard cubic feet of air per day. The gas being produced from the production well, which is open to atmospheric pressure, is monitored for the pressure of carbon dioxide, which indicated the successful ignition and sustained propagation of an in situ combustion front in the formation. Carbon dioxide is present in substantial quantities in the gas being produced from the production well, and so no additional treatment is necessary to insure successful ignition of the formation. Air injection continues at the above rate until oil production at the production well begins, and for 2 months thereafter. After 2 months, it is calculated that the combustion front had progressed approximately half way toward the production well. Water is thereafter injected into the injection well for the purpose of scavenging heat from the formation matrix and driving petroleum toward the production well, and water injection is continued until the water-oil ratio at the production well increases dramatically, after which this phase of the pilot operation is completed. It is determined that approximately 85% of the petroleum contained in the portion of the formations swept by the injected air is recovered by means of this technique, which is a very satisfactory operation.

FIELD EXAMPLE 2

A subterranean tar sand deposit is located under an overburden thickness of 125 feet, and it is determined that the thickness of the tar sand deposit is 70 feet. This is considered to be too deep for efficient strip mining, and so some form of in situ separation of the bituminous petroleum contained in the tar sand deposit must be accomplished.

An injection well and production well are drilled into the bottom of the tar sand deposit and perforations established in tubing placed in the well throughout the full thickness of the tar sand interval. Air is injected into the injection well at a pressure of 100 pounds per square inch. Since the ambient temperature at the surface is 25° F, no cooling of the compressed air is necessary to maintain it below a temperature of 150° F. A choke is placed in the production well so that air will pass from the formation to the surface of the earth therethrough, but a back pressure is maintained to insure that the pressure in the tar sand deposit adjacent the production well tubing perforations does not exceed about 50 pounds per square inch. Static, unheated air treating of this formation is not thought to be feasible because of the low pressure tolerance of this relatively shallow deposit, and also because of the substantial lateral extent of the deposit which would require pressuring a very large earth formation in order to pretreat a substantially small portion thereof for subsequent oil recovery operations.

Air is injected at a pressure of 100 pounds per square inch for a period of 5 weeks, in order to insure that the highly viscous, bituminous petroleum is adequately pretreated prior to the subsequent oil recovery process steps.

After the 5 weeks pretreatment phase, a steam generator is installed and a mixture of steam and compressed air are introduced into the formation to initiate and propagate a controlled low temperature oxidation reaction through the formation. The ratio of air to steam is gradually increased from essentially pure air in the pretreatment phase to a final target value of 1 standard cubic foot of air per pound of steam, which value is thereafter maintained essentially constant. This mixture of steam and air is injected at a temperature of 325° F until approximately one pore volume of water as steam has been injected into the formation, which is considered to be the optimum value. At the conclusion of this operation, approximately 73% of the bituminous petroleum has been recovered from that portion of the tar sand deposit swept by the injected fluids in this pilot field operation.

EXPERIMENTAL RESULTS

In order to verify the operability of the present invention, and further to determine the preferred operating parameters and the extent of improvement resulting therefrom, a series of laboratory experiments were performed utilizing tar sand samples obtained from a mining operation being conducted in the Athabasca tar sand deposits in Alberta, Canada. A laboratory simulator was utilized which is essentially a steel pipe approximately 18 inches in diameter and 15 inches tall, equipped with appropriate sealing means and one injection well and one production well in the oil. Tar sand material is packed into the cell and hydraulic pressure is applied to the upper cell member in order to simulate overburden pressure and to compact the tar sand material to a density essentially equivalent to a typical subterranean deposit.

Two different samples were utilized in the two laboratory tests conducted according to the above described procedures. One was a sample which had been obtained several months prior to the laboratory tests. During the course of handling this sample, it had been exposed to air at ambient temperatures and essentially atmospheric pressure, so that a low temperature oxidation pretreatment had occurred to a substantial extent. The second sample was a relatively fresh sample which had been carefully handled to avoid contact with the air, and so represents as near as is possible to obtain under laboratory conditions, the material as would be encountered in a subterranean formation which had not been subjected to an unheated air pretreatment period for a substantial period of time. Recovery in both cases was by injection of a mixture of steam and oxygen, so as to cause a low temperature combustion reaction to occur. The experiment conducted utilizing the new sample resulted in recovering 22.5% (an average of two separate runs), whereas the same recovery technique applied to the old sample, which had been exposed to air at atmospheric pressure for a period of months, resulted in the recovery of 69% of the bituminous petroleum charged in the cell.

Thus as can be seen from the above data that substantially better than twice as much bituminous petroleum is recovered by application of a modified in situ combustion type reaction using a sample which has been exposed to air at atmospheric pressure for a long period of time, as compared to a substantially unpretreated sample. The tar sand materials were otherwise essentially identical, having been obtained from the same general area.

The laboratory cell described above was additionally equipped with thermo couples at various points throughout the tar sand material, and the temperature at these sampling points was monitored continually during the course of recovery operation. The temperature profiles obtained during the running of the air-aged sample showed temperature gradients radiating in a generally even fashion between the injection well and production well, as is desired in a uniform in situ combustion reaction. By contrast, hot spots appeared in the trash tar sand material in the vicinity of the producing well and in the cell at points about mid way between the injection well and the producing well, early in the course of the experiments. This clearly indicated that the sample which had been preconditioned by prolonged exposure to air at atmospheric pressure did not experience the occurrence of random pockets of in situ combustion, whereas the untreated, fresh virgin sample was very prone to the occurrence of random zones of spontaneously ignited combustion within the cell.

Thus I have disclosed that the percent oil recovery can be increased substantially, and the tendency for random pockets of in situ combustion to occur within a portion of a tar sand formation is reduced materially, by pretreatment of the material with unheated air for a adequate period of time to properly condition the material prior to the application thereto of a combustive reaction type of recovery procedure.

While may invention has been described in terms of a number of specific illustrative embodiments, it is not so limited since many variations thereof will be apparent to persons skilled in the art of oil recovery without departing from the true spirit and scope of my invention. Similarly, while a mechanism has been described to explain the benefit resulting from application of the process of my invention, it is not necessarily represented hereby that this is the only or even the principal mechanism responsible for improvements in the application of the process of my invention. It is my invention and desire that my invention by limited and restricted only by those limitations and restrictions appearing in the claims appended immediately hereafter.

I claim:

1. A method of recovering viscous petroleum from subterranean, viscous petroleum containing formations penetrated by at least one injection well and by at least one production well, both wells being in fluid communication with the petroleum containing formation, of the type wherein the formation adjacent the injection well is heated to a temperature sufficient to cause a combustive reaction to occur, and thereafter a first oxygen containing gas is injected into the formation via the injection well for the purpose of propogating a combustive reaction zone through the formation to stimulate recovery of petroleum from the formation via the production well, wherein the improvement comprises:

introducing a second, unheated oxygen-containing gas at a temperature of 150° F or less, into the formation, via the injection well, and allowing the unheated oxygen-containing gas to remain in contact with the formation petroleum for a period of time of at least 20 days prior to the steps of heating the formation and injecting the first oxygen containing gas into the formation, to cause a low temperature oxidative reaction to occur in the formation, thereby preconditioning the viscous petroleum.

2. A method as recited in claim 1 wherein the oxygen containing gas is air.

3. A method as recited in claim 1 wherein the oxygen containing gas is essentially pure oxygen.

4. A method as recited in claim 1 wherein the oxygen containing gas is compressed and then cooled prior to being injected into the subterranean petroleum containing formation.

5. A method as recited in claim 1 wherein the oil recovery method involves injection of heated air into the formation for the purpose of initiating an in situ combustion reaction.

6. A method as recited in claim 1 wherein the oil recovery method accomplished after the unheated oxygen containing gas pretreatment phase involves introduction into the formation of a mixture of an oxygen containing gas and steam.

7. A method as recited in claim 1 wherein the oxygen containing gas is injected into the formation from a period of about 50 to about 100 days.

8. A method as recited in claim 1 wherein the oxygen containing gas is injected into the formation for a period of from 20 to about 200 days.

9. A method as recited in claim 1 wherein the oxygen containing gas is injected into the formation until the pressure of the formation is raised to a preselected value, after which the injection well and production well are shut in and the oxygen containing gas is allowed to remain in the formation for a period of from about 20 to about 40 days.

10. A method as recited in claim 1 wherein the oxygen containing gas is injected into the injection well and the production well is open to the atmosphere, the oxygen containing gas has a temperature below about 250° F being caused to flow through the formation for a period from about 20 to about 60 days.

* * * * *